US006551489B2

(12) United States Patent
D'Astolfo, Jr. et al.

(10) Patent No.: US 6,551,489 B2
(45) Date of Patent: Apr. 22, 2003

(54) RETROFIT ALUMINUM SMELTING CELLS USING INERT ANODES AND METHOD

(75) Inventors: LeRoy E. D'Astolfo, Jr., Lower Burrell, PA (US); Giuseppe Lazzaro, Sardinia (IT)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/759,949

(22) Filed: Jan. 12, 2001

(65) Prior Publication Data

US 2001/0035344 A1 Nov. 1, 2001

Related U.S. Application Data

(60) Provisional application No. 60/175,933, filed on Jan. 13, 2000.

(51) Int. Cl.[7] ..... C25C 3/06; C25C 3/00

(52) U.S. Cl. ..... 205/389; 204/245

(58) Field of Search ..... 205/372, 389; 204/245

(56) References Cited

U.S. PATENT DOCUMENTS

| | | | | |
|---|---|---|---|---|
| 2,480,474 A | | 8/1949 | Johnson | 204/67 |
| 3,126,326 A | | 3/1964 | Frerotti et al. | 204/67 |
| 3,616,317 A | | 10/1971 | McLellan | 204/67 |
| 3,756,929 A | | 9/1973 | Schmidt-Hatting et al. | 204/67 |
| 4,045,307 A | | 8/1977 | Turley | 204/64 |
| 4,097,228 A | | 6/1978 | Rosling | 432/250 |
| 4,187,155 A | | 2/1980 | de Nora et al. | 204/67 |
| 4,261,807 A | | 4/1981 | Blanc | 204/243 |
| 4,342,178 A | | 8/1982 | Benton et al. | 52/125.5 |
| 4,374,050 A | | 2/1983 | Ray | 252/519 |
| 4,374,761 A | | 2/1983 | Ray | 252/519 |
| 4,392,925 A | * | 7/1983 | Alder et al. | 205/375 |
| 4,399,008 A | | 8/1983 | Ray | 204/67 |
| 4,455,211 A | | 6/1984 | Ray et al. | 204/293 |
| 4,582,585 A | | 4/1986 | Ray | 204/243 |
| 4,584,172 A | | 4/1986 | Ray et al. | 419/34 |
| 4,592,813 A | | 6/1986 | Henry | 204/67 |
| 4,608,134 A | | 8/1986 | Brown | 204/67 |
| 4,620,905 A | | 11/1986 | Tarcy et al. | 204/64 R |
| 4,622,111 A | * | 11/1986 | Brown et al. | 205/378 |
| 4,687,439 A | | 8/1987 | Olivarez, Jr. et al. | 432/192 |
| 4,865,701 A | * | 9/1989 | Beck et al. | 205/375 |
| 4,992,146 A | | 2/1991 | Skaar et al. | 204/67 |
| 5,362,366 A | * | 11/1994 | de Nora et al. | 205/375 |
| 5,368,702 A | * | 11/1994 | de Nora | 205/375 |
| 5,415,742 A | * | 5/1995 | La Camera et al. | 204/245 X |
| 5,794,112 A | | 8/1998 | Ray et al. | 419/21 |
| 5,865,980 A | | 2/1999 | Ray et al. | 205/367 |
| 5,876,585 A | | 3/1999 | Schenk | 205/390 |
| 6,126,799 A | | 10/2000 | Ray et al. | 204/291 |

OTHER PUBLICATIONS

Cermet Inert Anode Containing Oxide and Metal Phases Useful for the Electrolytic Production of Metals—Ray et al., U.S. Ser. No. 09/629,332, Filed Aug. 1, 2000.

Method of Converting Hall–Heroult Cells to Inert Anode Cells for Aluminum Production—D'Astolfo, Jr. et al., U.S. Ser. No. 09/792,729, Filed Mar. 23, 2001.

* cited by examiner

*Primary Examiner*—Donald R. Valentine
(74) *Attorney, Agent, or Firm*—Alan G. Towner; Edward L. Levine

(57) ABSTRACT

Conventional aluminum smelting cells are retrofitted with inert anode assemblies which replace the consumable carbon anodes of the cell. The inert anode assemblies may include multiple inert anodes, and may also include insulation for reducing heat loss during operation of the retrofit cells.

10 Claims, 3 Drawing Sheets

RETROFIT ALUMINUM SMELTING CELLS USING INERT ANODES AND METHOD

CROSS REFERENCE TO RELATED APPLICATION

This application claims the benefit of U.S. Provisional Patent Application Ser. No. 60/175,933 filed Jan. 13, 2000.

FIELD OF THE INVENTION

The present invention relates to electrolytic aluminum production cells, and more particularly to the retrofitting of inert anodes into cells containing conventional carbon anodes.

BACKGROUND INFORMATION

Existing aluminum smelting cells use consumable carbon anodes which produce $CO_2$ and other gaseous by-products and must be frequently replaced. Inert, or non-consumable, consumable, anodes climinate these weaknesses, but would also change the heat balance of the cell. There are thousands of existing conventional cells, which would be cost-prohibitive to replace in their entireties. Accordingly, there is a need for a retrofit cell design that accepts inert anodes with minimal changes to existing cells.

SUMMARY OF THE INVENTION

An aspect of the present invention is to provide a method of retrofitting an aluminum smelting cell comprising replacing at least one consumable carbon anode of the cell with at least one inert anode.

Another aspect of the present invention is to provide a retrofit consumable carbon anode aluminum smelting cell comprising at least one inert anode.

These and other aspects of the present invention will be more apparent from the following description.

DETAILED DESCRIPTION

This invention provides a retrofit cell design which uses inert anode assemblies including top insulation and a horizontal array of inert anodes with a low voltage drop that do not require modifications to the cathode, refractory insulation or steel shell. The design conserves a substantial portion of the heat presently lost from a conventional cell (e.g., approximately one-third of the heat), at the same time avoiding undesirable increases in total voltage. This is done using a unique insulation package on top of the cell which can survive the severe conditions there, and an anode design which minimizes voltage losses through the anode material.

Figure 1:
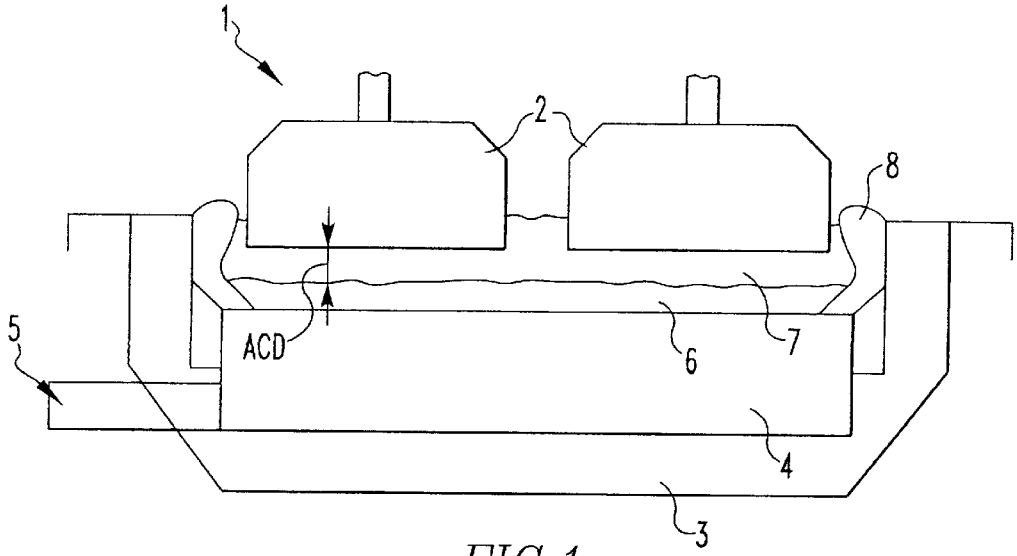
FIG.1 PRIOR ART
FIG. 1 is a partially schematic side view of a conventional aluminum production cell including conventional consumable carbon anodes.

FIG. 1 schematically illustrates a conventional aluminum production cell 1 including consumable carbon anodes 2.

The cell 1 includes a refractory material 3 supported by a steel shell. A cathode 4 made of carbon or the like is located on the refractory material 3. A current collector 5 is connected to the cathode 4. During operation of the cell 1, molten aluminum 6 forms on the surface of the cathode 4. The consumable carbon anodes 2 are immersed in an electrolytic bath 7. A frozen crust 8 of bath material typically forms around the sides of the cell 1.

Figure 2:
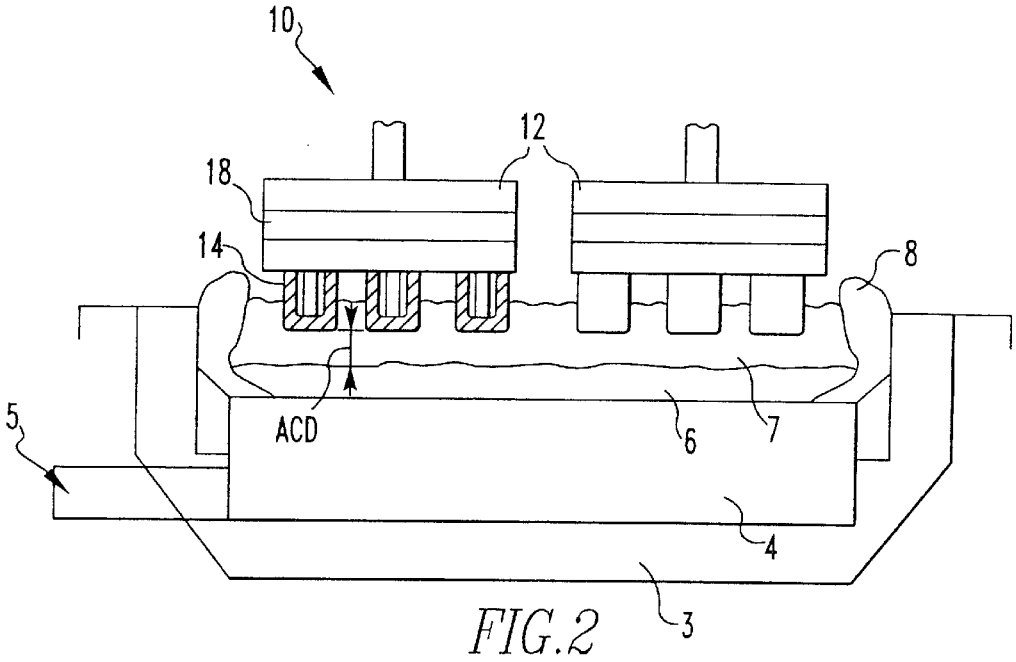
FIG. 2 is a partially schematic side view of an aluminum production cell retrofit with inert anode assemblies in accordance with an embodiment of the present invention.

FIG. 2 illustrates an aluminum production cell 10 retrofit with inert anode assemblies 12 in accordance with an embodiment of the present invention. The inert anode assemblies 12 shown in FIG. 2 replace the conventional consumable carbon anodes 2 shown in FIG. 1. Each carbon anode 2 may be replaced with a single inert anode assembly 12, as illustrated in FIGS. 1 and 2. Alternatively, the retrofit cell 10 may include more or less inert anode assemblies 12 in comparison with the number of carbon anodes 2 used in the conventional cell 1.

As shown in FIG. 2, each inert anode assembly 12 includes a substantially horizontal array of inert anodes 14 positioned below thermal insulation material 18. An inwardly extending peripheral lip (not shown) may optionally be provided around the upper edge of the cell 10 between the steel shell or refractory material 3 and the inert anode assemblies 12 in order to provide additional thermal insulation.

Figure 3:
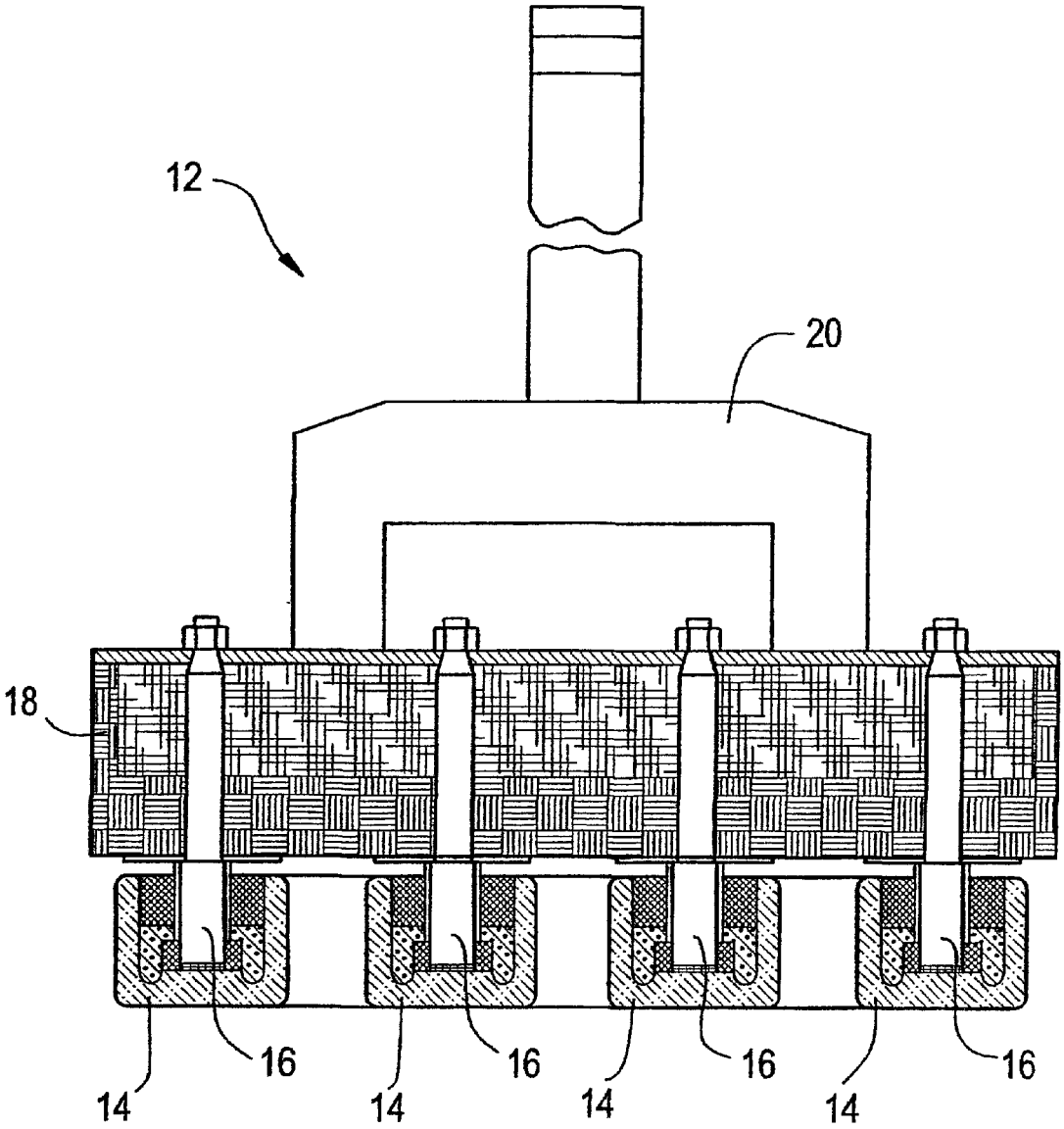
FIG. 3 is a side sectional view of an inert anode assembly intended to replace a conventional consumable carbon anode in accordance with an embodiment of the present invention.
Figure 4:
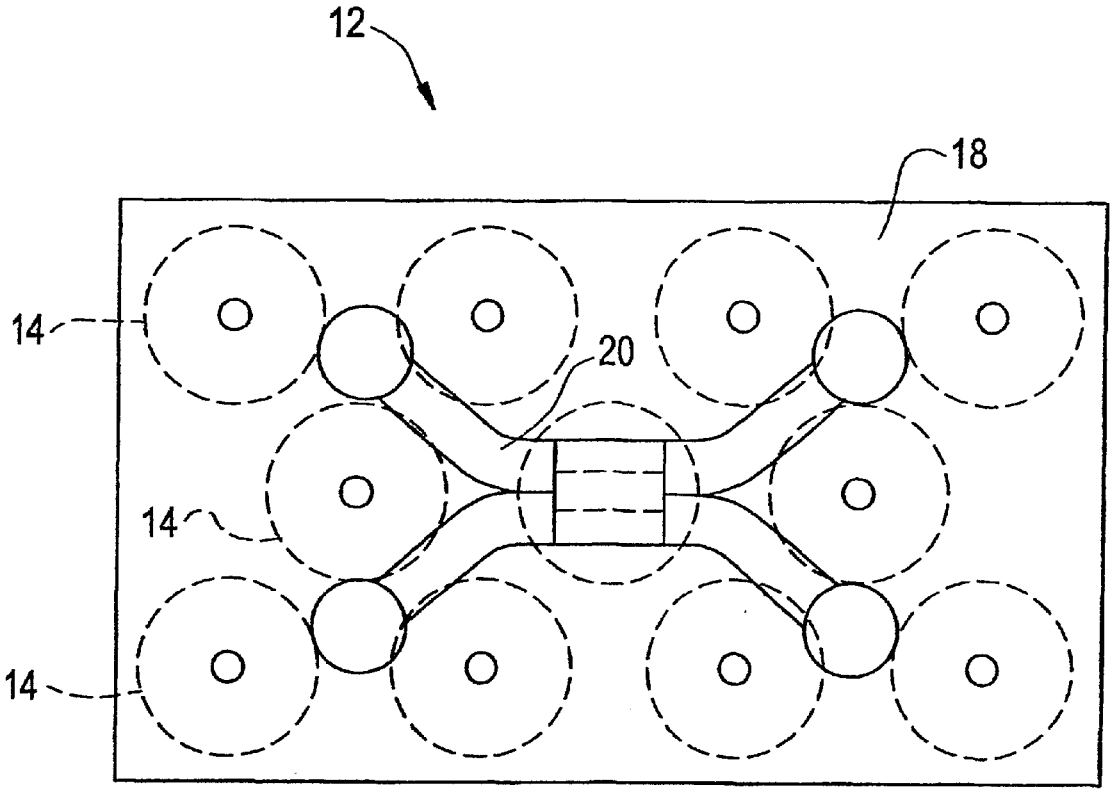
FIG. 4 is a top view of the inert anode assembly of FIG. 3.

FIGS. 3 and 4 illustrate an inert anode assembly 12 in accordance with an embodiment of the present invention. The assembly 12 includes a substantially horizontal array of inert anodes 14. In the embodiment shown in FIGS. 3 and 4, eleven staggered inert anodes 14 are used. However, any suitable number and arrangement of inert anodes may be used. As shown in FIG. 3, each inert anode 14 is electrically and mechanically fastened by a connector 16 to an insulating lid 18. The insulating lid 18 is connected to an electrically conductive support member 20.

Any desired inert anode shape or size may be used. For example, the substantially cylindrical cup-shaped inert anodes 14 shown in FIGS. 3 and 4 may have diameters of from about 5 to about 30 inches and heights of from about 5 to about 15 inches. The composition of each inert anode 14 may include any suitable metal, ceramic, cermet, etc. which possesses satisfactory corrosion resistance and stability during the aluminum production process. For example, inert anode compositions disclosed in U.S. Pat. Nos. 4,374,050, 4,374,761, 4,399,008, 4,455,211, 4,582,585, 4,584,172, 4,620,905, 5,794,112 and 5,865,980, and U.S. patent application Ser. No. 09/629,332 filed Aug. 1, 2000, each of which is incorporated herein by reference, may be suitable for use in the present inert anodes 14. Each inert anode 14 may comprise a uniform material throughout its thickness, or may include a more corrosion resistant material in the regions exposed to the electrolytic bath. Hollow or cup-shaped inert anodes may be filled with protective material, as shown in FIG. 3, in order to reduce corrosion of the connectors and the interface between the connectors and the inert anodes.

The connectors 16 may be made of any suitable materials which provide sufficient electrical conductivity and mechanical support for the inert anodes 14. For example, each connector 16 may be made of Inconel. Optionally, a highly conductive metal core such as copper may be provided inside an Inconel sleeve. Each connector 16 may optionally include separate components for providing mechanical support and supplying electrical current to the inert anodes 14.

As shown in FIG. 3, the insulating lid 18 mechanically supports and provides an electrical connection to each connector 16. The insulating lid 18 preferably includes one or more thermal insulating layers of any suitable composition(s). For example, a highly corrosion resistant refractory insulating material may be provided on the exposed regions of the insulating lid 18, while a material having higher thermal insulation properties may be provided in the interior regions. The insulating lid 18 may also include an electrically conductive metal plate which provides a current path from the conductive support member 20 to the connectors 16, as shown in FIG. 3. The conductive metal plate may be at least partially covered with a thermally insulating and/or corrosion resistant material (not shown). Although not shown in FIG. 3, electrically conductive elements such as copper straps may optionally be provided between the conductive support member 20 and connectors 16.

In accordance with the present invention, inert anode assemblies may be used to replace consumable carbon anodes in conventional aluminum production cells with little or no modifications to the other components of the cell, such as the cathode, refractory insulation or steel shell. The present invention provides several advantages, including the capital savings achieved from avoidance of major modifications or total replacement of existing cells.

Whereas particular embodiments of this invention have been described above for purposes of illustration, it will be evident to those skilled in the art that numerous variations of the details of the present invention may be made without departing from the invention as defined in the appended claims.

What is claimed is:

1. A method of retrofitting an aluminum smelting cell, the method comprising replacing at least one consumable carbon anode of the cell with an inert anode assembly comprising at least one thermal insulation material and a substantially horizontal array of inert anodes located below at least a portion of the thermal insulation material, wherein the cell comprises a cathode having a substantially horizontal upper surface, each inert anode has a lowermost surface, and the lowermost surfaces of the inert anodes are spaced substantially equal distances in a vertical direction from the substantially horizontal upper surface of the cathode.

2. The method of claim 1, wherein the array of inert anodes comprises at least four of the inert anodes.

3. The method of claim 1, wherein the array of inert anodes is connected to at least one electrically conductive support member.

4. The method of claim 1, wherein the array of inert anodes replaces a single consumable carbon anode.

5. The method of claim 1, wherein the array of inert anodes replaces more than one of the consumable carbon anodes.

6. A retrofit consumable carbon anode aluminum smelting cell comprising an inert anode assembly including at least one thermal insulation material and a substantially horizontal array of inert anodes located below at least a portion of the thermal insulation material, wherein the cell comprises a cathode having a substantially horizontal upper surface, each inert anode has a lowermost surface, and the lowermost surfaces of the inert anodes are spaced substantially equal distances in a vertical direction from the substantially horizontal upper surface of the cathode.

7. The retrofit consumable carbon anode aluminum smelting cell of claim 6, wherein the array of inert anodes comprises at least four of the inert anodes.

8. The retrofit consumable carbon anode aluminum smelting cell of claim 6, wherein the array of inert anodes is connected to at least one electrically conductive support member.

9. The retrofit consumable carbon anode aluminum smelting cell of claim 6, wherein the array of inert anodes replaces a single consumable carbon anode.

10. The retrofit consumable carbon anode aluminum smelting cell of claim 6, wherein the array of inert anodes replaces more than one of the consumable carbon anodes.

* * * * *